US012618228B2

(12) United States Patent
Kim et al.

(10) Patent No.: US 12,618,228 B2
(45) Date of Patent: May 5, 2026

(54) METHOD AND DEVICE FOR CONTROLLING EXCAVATOR

(71) Applicant: VOLVO AUTONOMOUS SOLUTIONS AB, Gothenburg (SE)

(72) Inventors: Sungsu Kim, Changwon-si (KR); Jiyun Kim, Changwon-si (KR)

(73) Assignee: VOLVO AUTONOMOUS SOLUTIONS AB, Gothenburg (SE)

( * ) Notice: Subject to any disclaimer, the term of this patent is extended or adjusted under 35 U.S.C. 154(b) by 210 days.

(21) Appl. No.: 18/268,827

(22) PCT Filed: Dec. 28, 2020

(86) PCT No.: PCT/KR2020/019175
§ 371 (c)(1),
(2) Date: Jun. 21, 2023

(87) PCT Pub. No.: WO2022/145498
PCT Pub. Date: Jul. 7, 2022

(65) Prior Publication Data
US 2024/0271393 A1 Aug. 15, 2024

(51) Int. Cl.
*E02F 9/26* (2006.01)

(52) U.S. Cl.
CPC ..... *E02F 9/265* (2013.01); *E02F 9/262* (2013.01)

(58) Field of Classification Search
None
See application file for complete search history.

(56) References Cited

U.S. PATENT DOCUMENTS

| | | | | |
|---|---|---|---|---|
| 6,108,949 | A | 8/2000 | Singh et al. | |
| 2019/0003152 | A1 | 1/2019 | Nakamura et al. | |
| 2020/0240117 | A1 | 7/2020 | Cheng et al. | |
| 2020/0407939 | A1* | 12/2020 | Aizawa | E02F 3/435 |
| 2021/0254312 | A1* | 8/2021 | Oi | E02F 9/261 |

FOREIGN PATENT DOCUMENTS

| | | | |
|---|---|---|---|
| JP | 11247230 | A | 9/1999 |
| JP | 2020020154 | A | 2/2020 |
| JP | 2020033836 | A | 3/2020 |
| KR | 101751164 | B1 | 6/2017 |

OTHER PUBLICATIONS

International Search Report and Written Opinion of the International Searching Authority, PCT/KR2020/019175, mailed Sep. 27, 2021, 7 pages.
Extended European Search Report, European Application No. 20968049.5, mailed Sep. 10, 2024, 8 pages.

* cited by examiner

*Primary Examiner* — James M Mcpherson
(74) *Attorney, Agent, or Firm* — Sage Patent Group

(57) ABSTRACT

A method for controlling an excavator includes obtaining height information indicating a height according to a plane coordinate of a target object; obtaining, based on the height information, bend information of the target object according to a plurality of orientation angles which are angles between a reference direction and orientations direction of a bucket; determining, based on the bend information, volumes which can be dug corresponding to the plurality of orientation angles; determining, based on the volumes which can be dug, one or more orientation angles among the plurality of orientation angles; and digging according to the one or more orientation angles.

15 Claims, 10 Drawing Sheets

[Fig. 1]
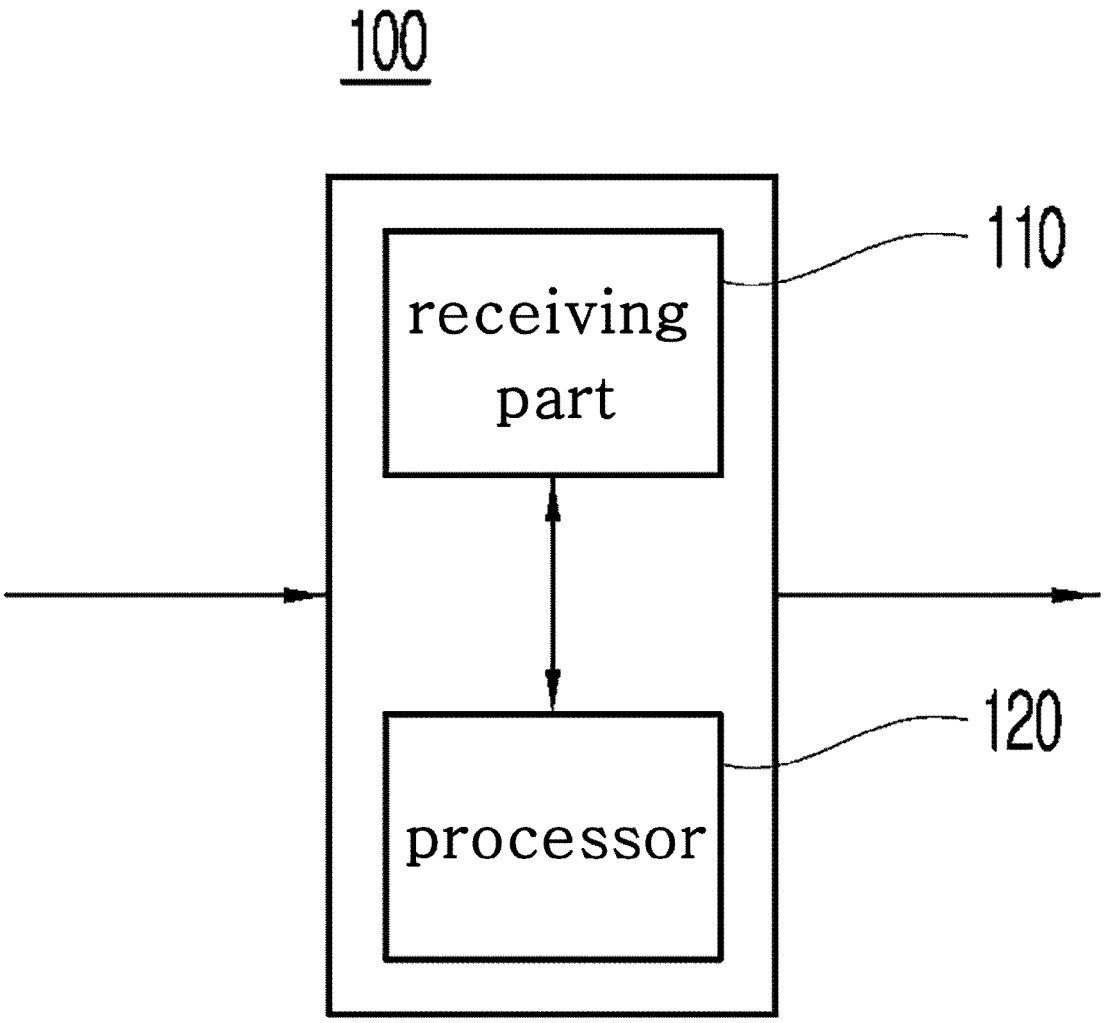

[Fig. 2]
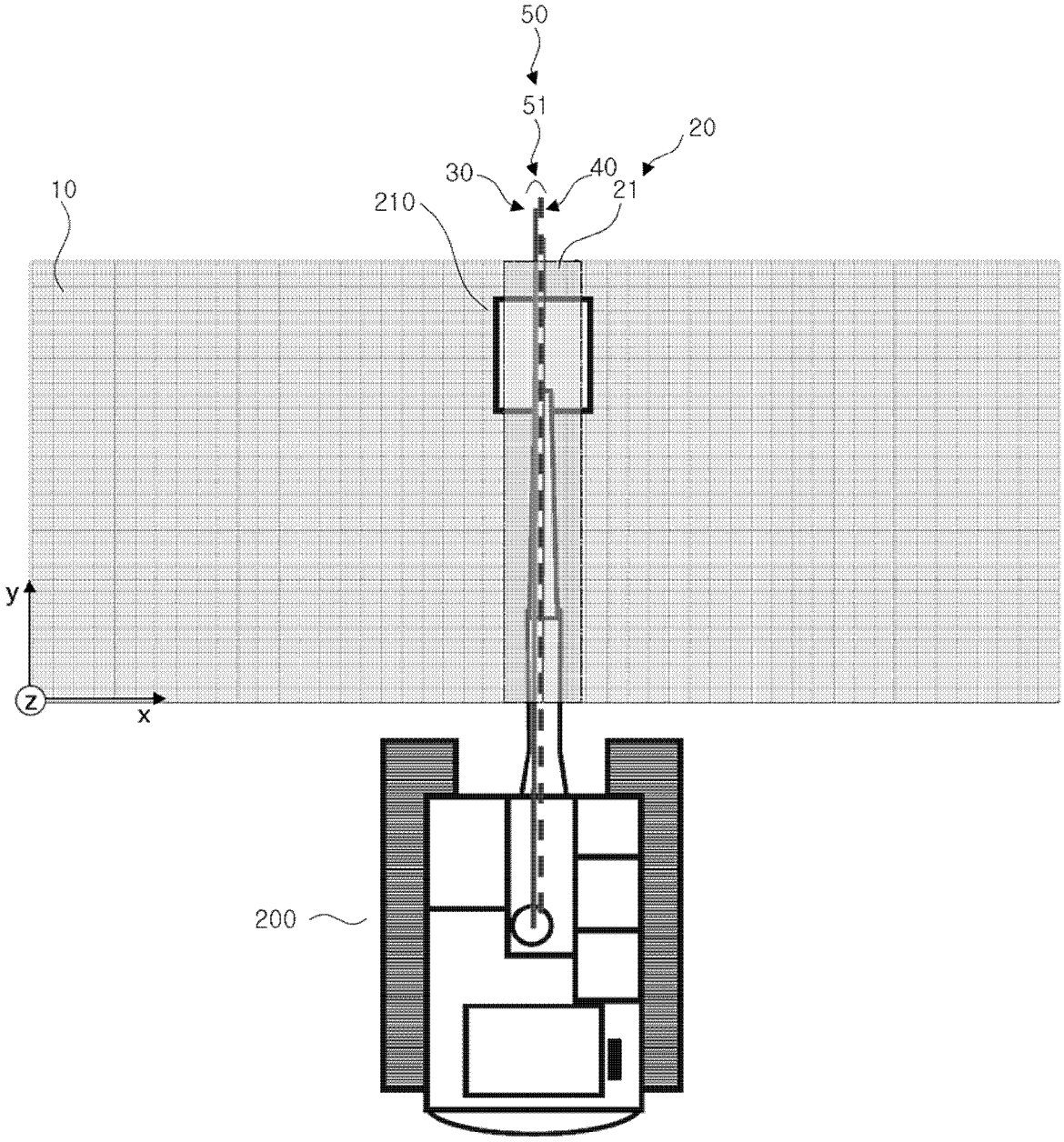

[Fig. 3]
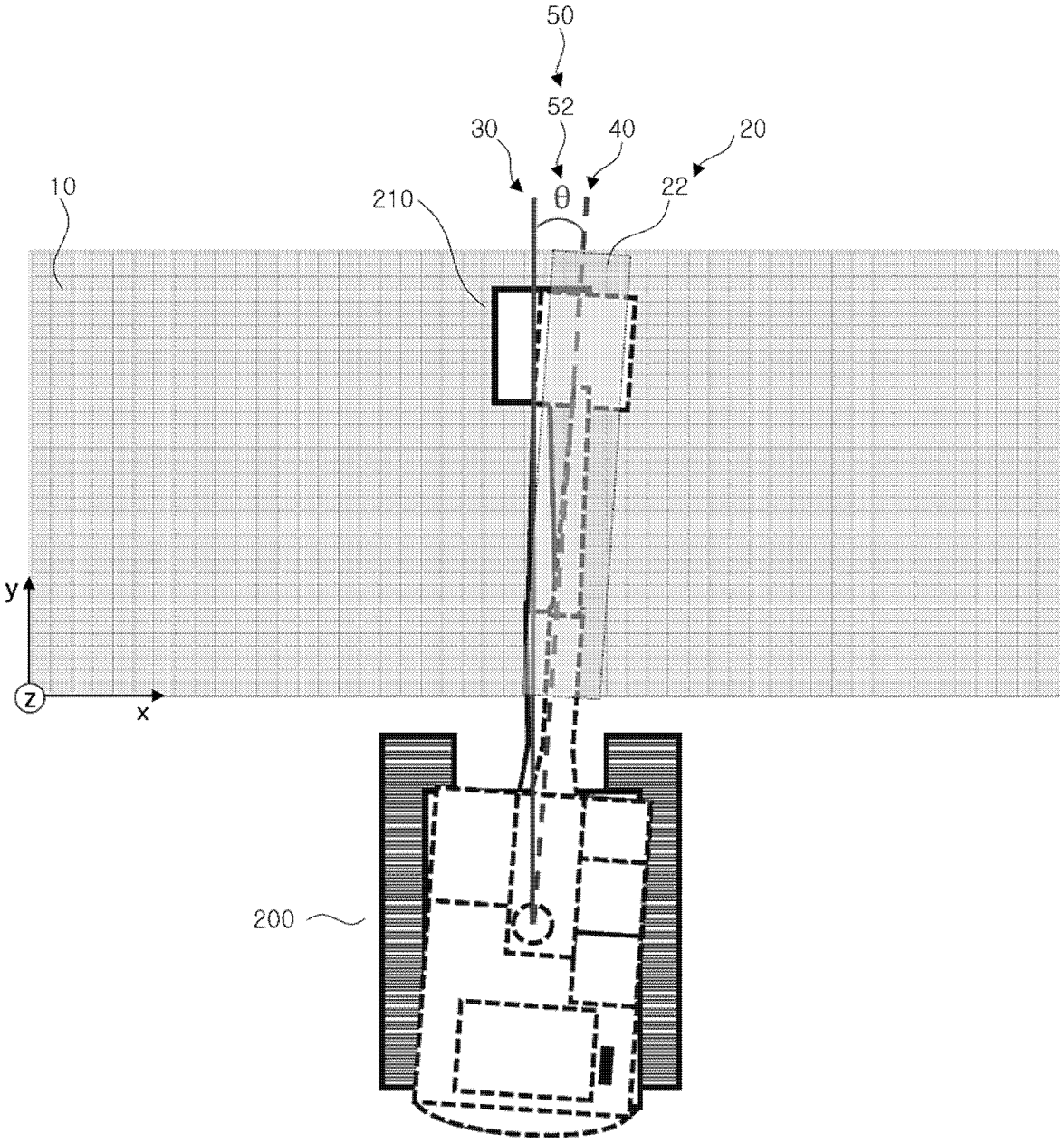

[Fig. 4]
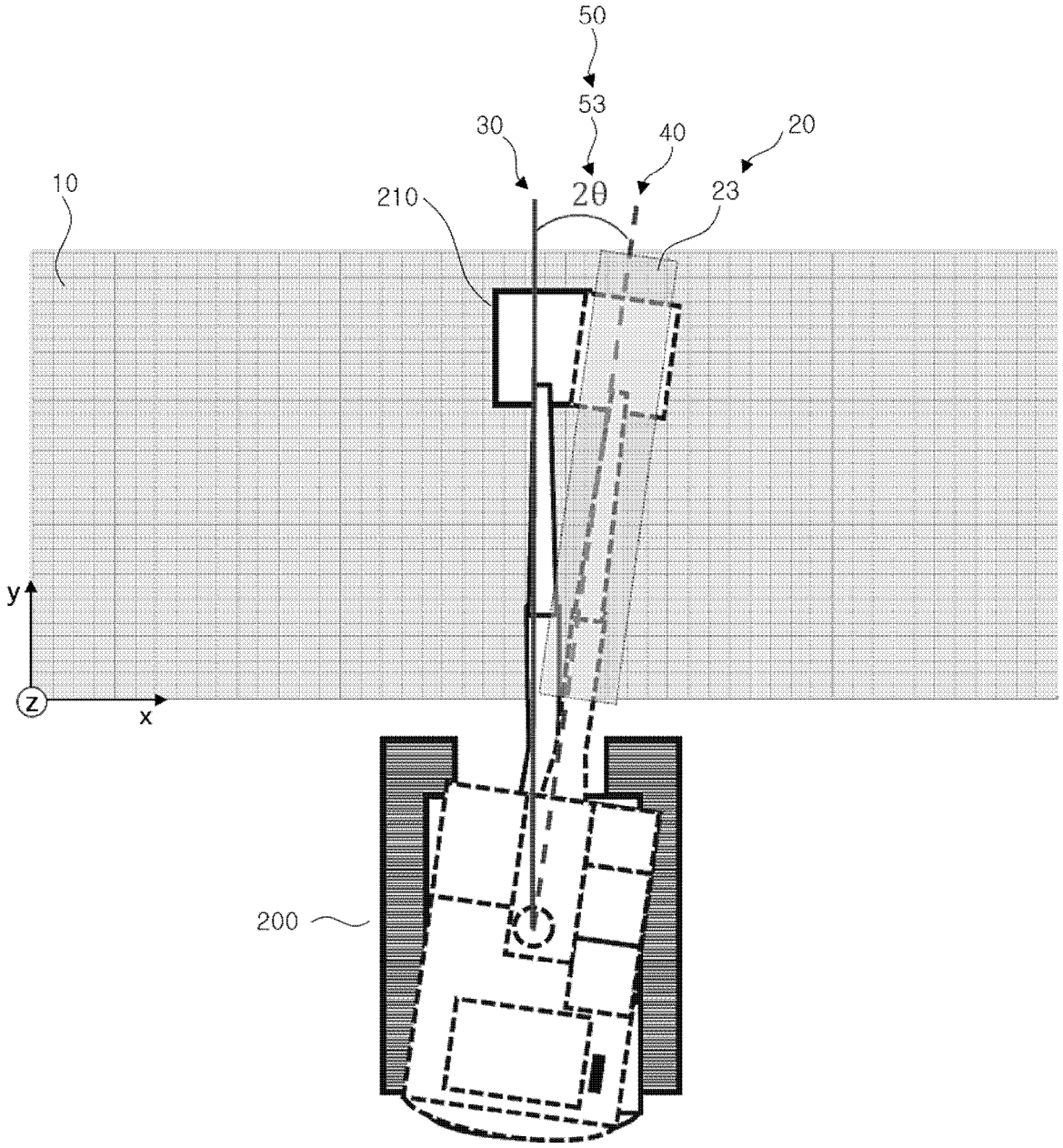

[Fig. 5]
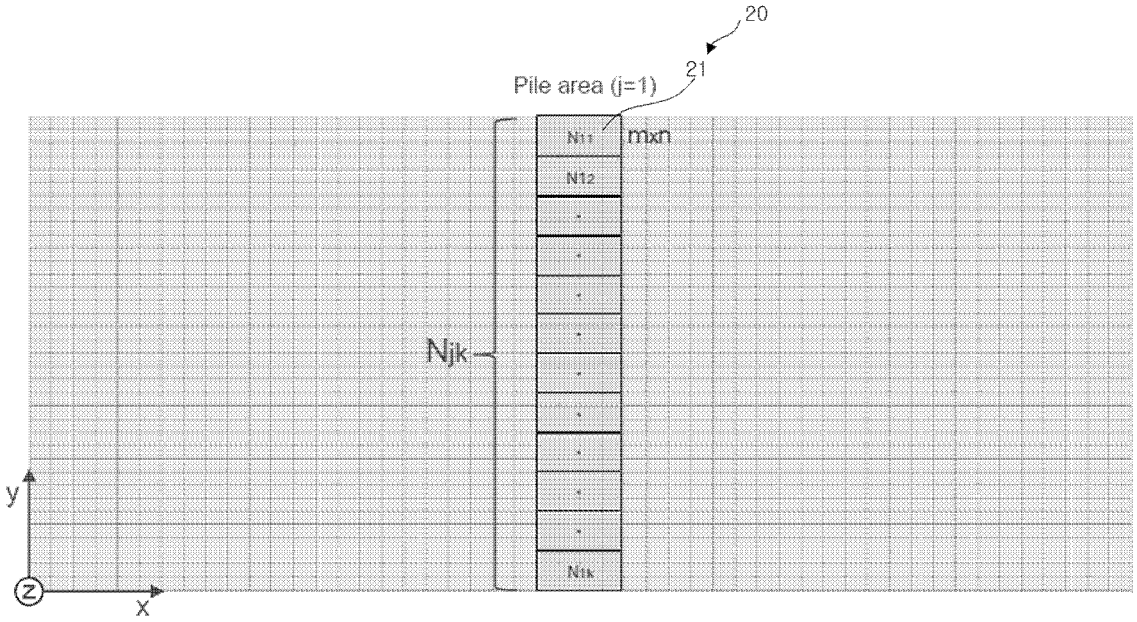

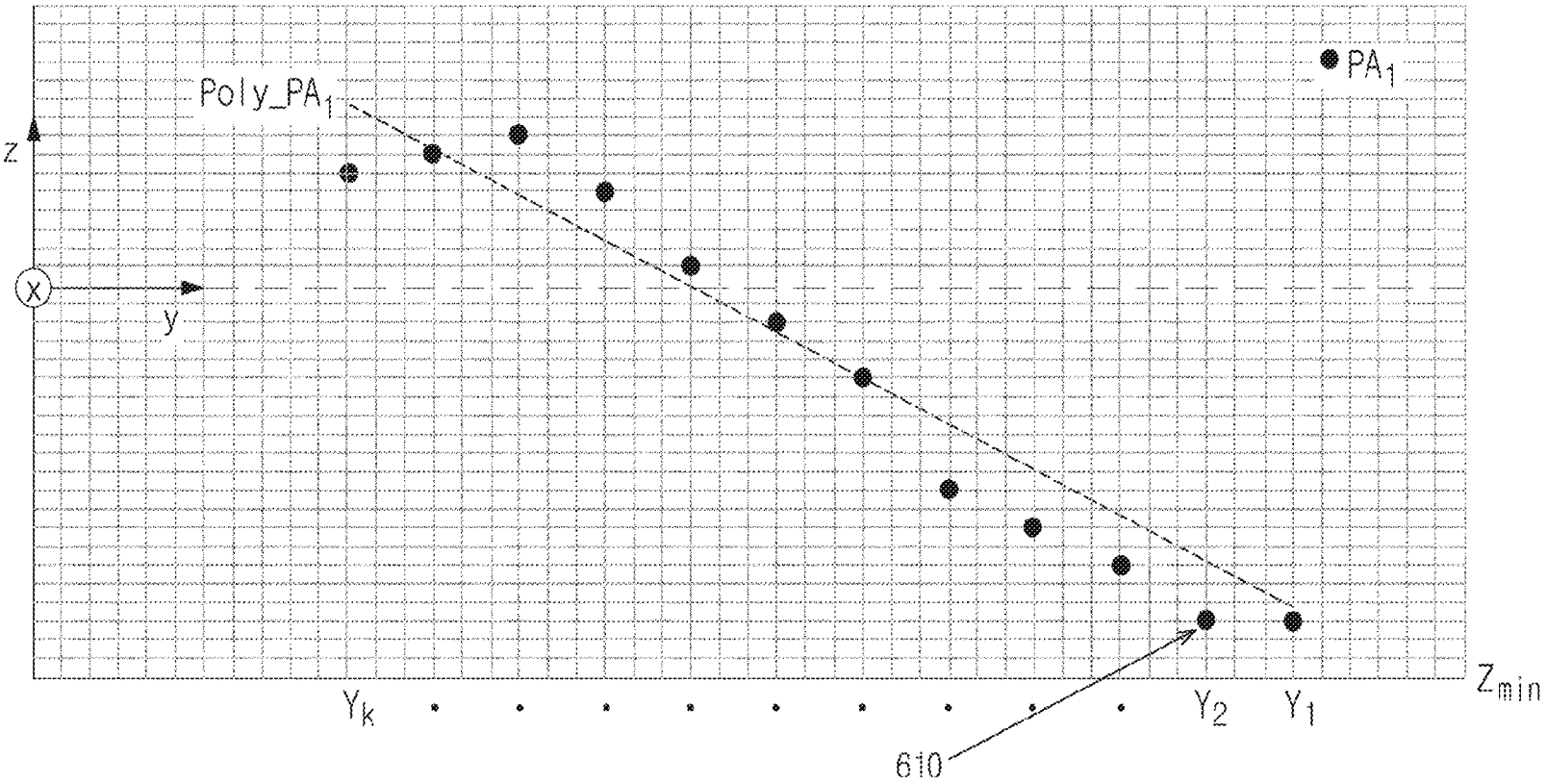
[Fig. 6]

[Fig. 7]
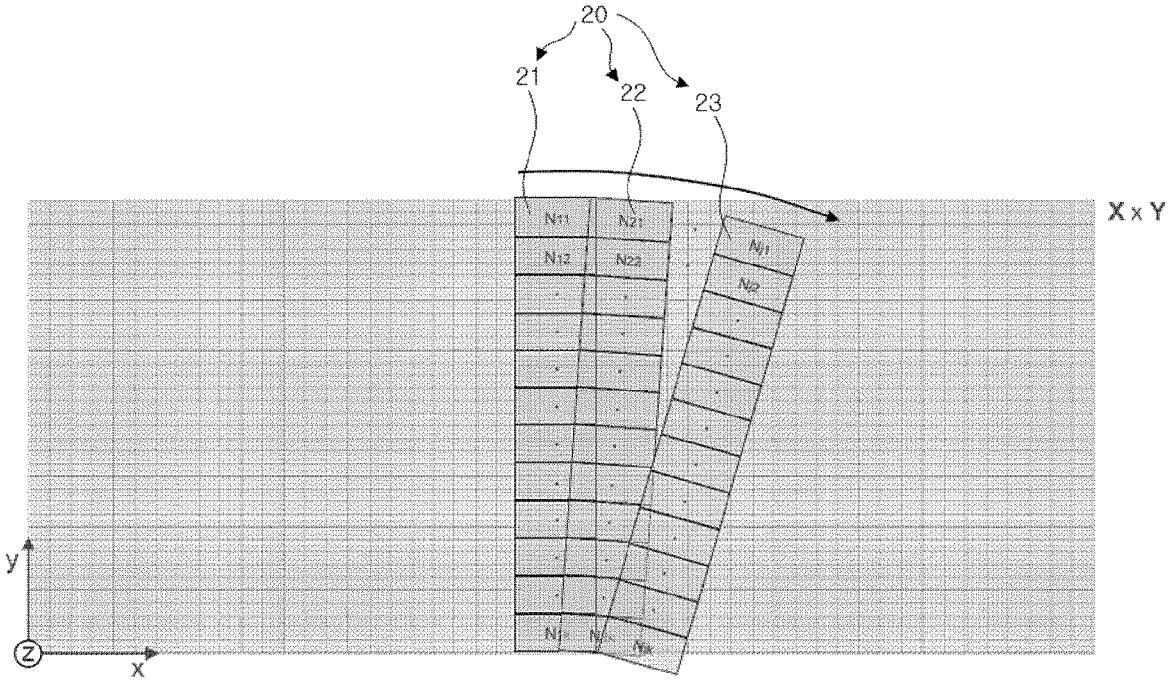

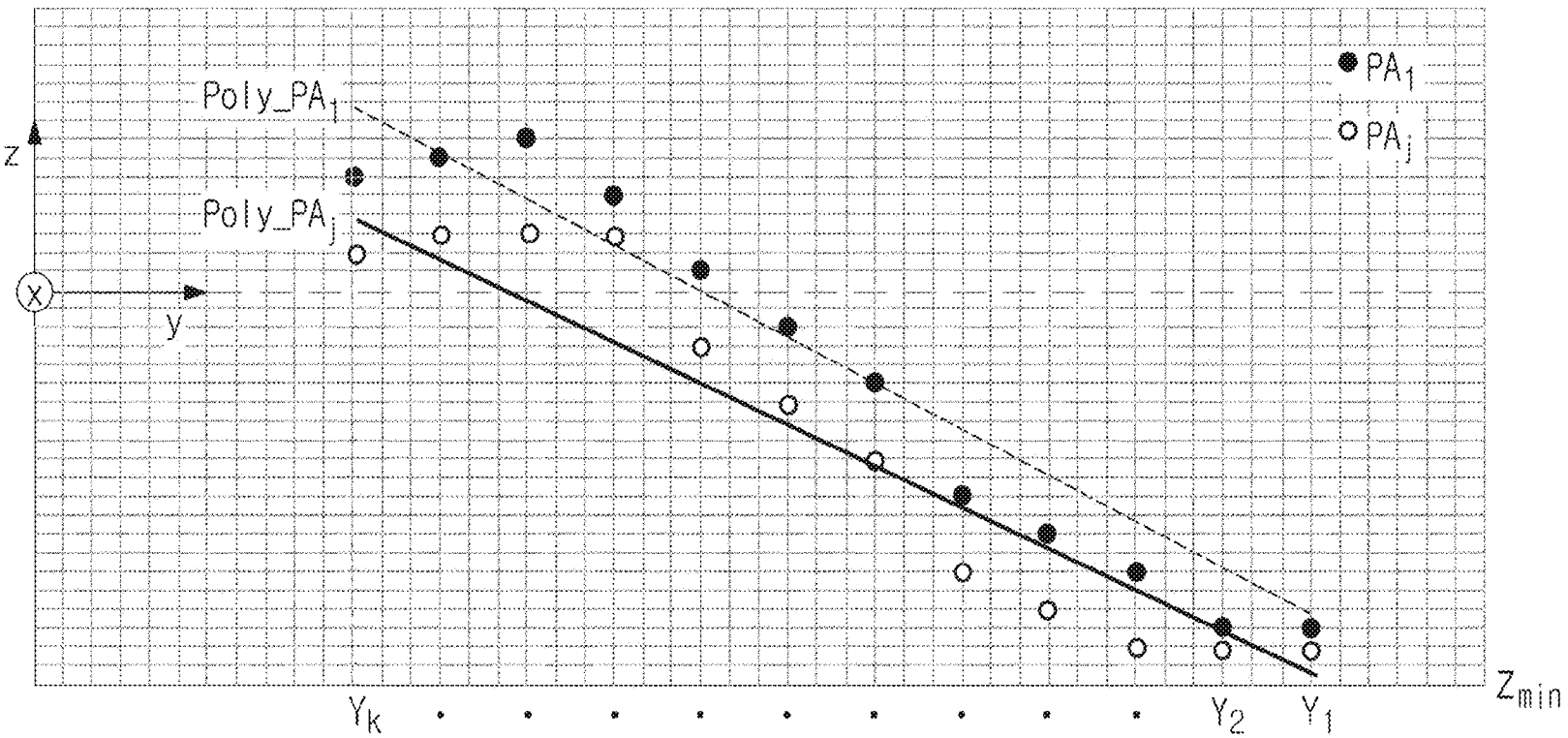
[Fig. 8]

[Fig. 9]
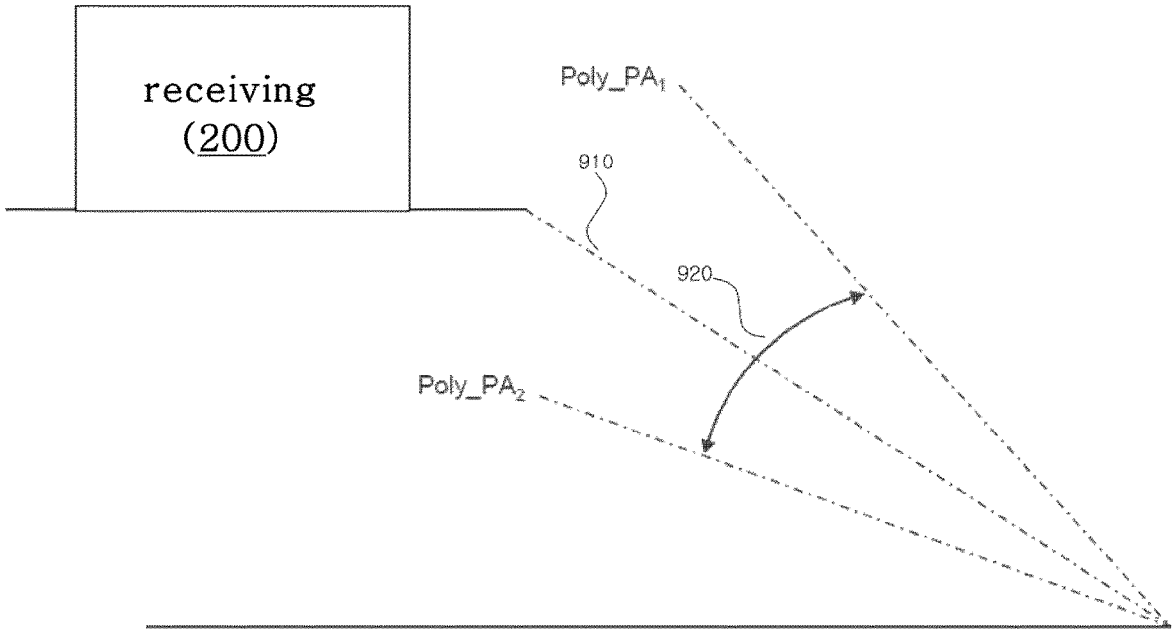

[Fig. 10]
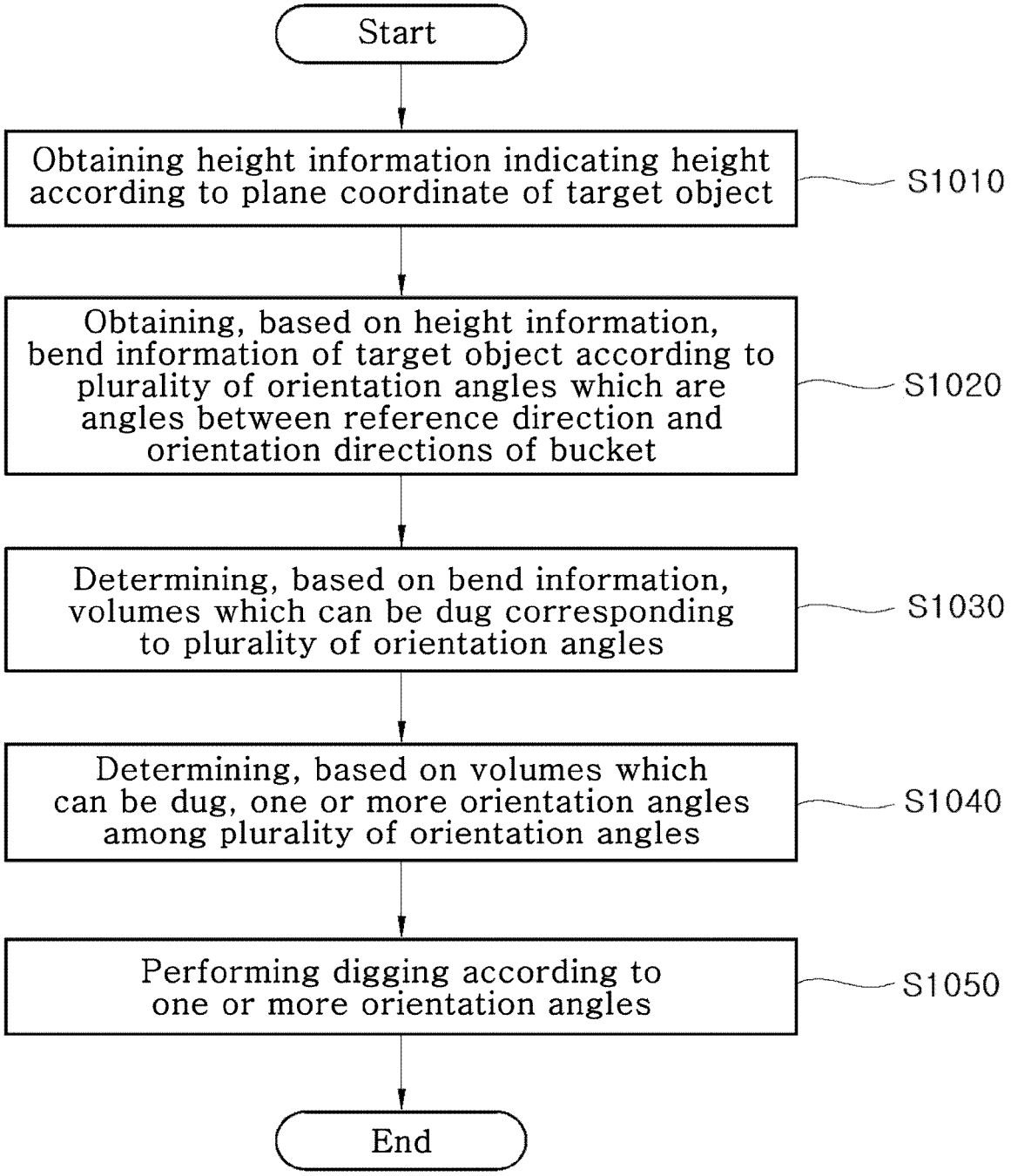

METHOD AND DEVICE FOR CONTROLLING EXCAVATOR

CROSS REFERENCE TO RELATED APPLICATIONS

This application is a 35 U.S.C. § 371 national stage application of PCT International Application No. PCT/KR2020/019175 filed on Dec. 28, 2020, the disclosure and content of which is incorporated by reference herein in its entirety.

TECHNICAL FIELD

The present disclosure relates to a method and a device for controlling an excavator. More specifically, the present disclosure relates to a method and a device capable of effectively digging according to one or more orientation angles based on bend information of a target object according to a plurality of orientation angles.

BACKGROUND

In general, the excavation work of excavators is controlled by operators' manual operation. The operation of excavators is complicated, and the operation techniques of each operator are different. Thus, the outcome of excavation depends on operators.

Accordingly, there are demands for autonomous excavation techniques that can solve the aforementioned problems and accurately determine the site and trace for excavation.

SUMMARY

An embodiment of the present disclosure is to solve the aforementioned problems of prior art, and provides a method and a device capable of effectively digging according to one or more orientation angles based on bend information of a target object according to a plurality of orientation angles.

The object of the present disclosure is not limited to the aforementioned object, and other objects that are not mentioned can be clearly understood from the following description.

A method for controlling an excavator according to a first aspect of the present disclosure comprises obtaining height information indicating a height according to a plane coordinate of a target object; obtaining, based on the height information, bend information of the target object according to a plurality of orientation angles which are angles between a reference direction and orientation directions of a bucket; determining, based on the bend information, volumes which can be dug corresponding to the plurality of orientation angles; determining, based on the volumes which can be dug, one or more orientation angles among the plurality of orientation angles; and digging according to the one or more orientation angles.

Also, the one or more orientation angles may include an orientation angle corresponding to a largest volume which can be dug among the plurality of orientation angles.

Also, the determining volumes which can be dug may comprise determining scan areas corresponding to the plurality of orientation angles; and determining as the volumes which can be dug volumes of the target object overlapped in the scan areas.

Also, the bend information may include information of inclination angles of the target object overlapped in the scan areas, and the inclination angles corresponding to the one or more orientation angles may fall within a predetermined range.

Also, the one or more orientation angles may include an orientation angle corresponding to a greatest inclination angle among the plurality of orientation angles.

Also, the determining the one or more orientation angles may comprise determining, using the bend information, orientation angles within a range where inclination angles of the target object fall within a predetermined range among the plurality of orientation angles; and determining the one or more orientation angles among the orientation angles within the range based on the volumes which can be dug and the inclination angles.

Also, the digging according to the one or more orientation angles may comprise determining scan areas corresponding to the one or more orientation angles; determining a low point in the scan areas based on bend information corresponding to the scan areas; and performing digging such that the digging starts at the low point.

Also, the low point may include a point where the target object has a lowest height in the scan areas.

Also, the low point may be less than an average height of the target object in the scan areas by a predetermined value or more, and the rate of change of height of the target object in the scan areas may correspond to 0.

Also, the height information may include values indicating an average height per unit area of the target object.

A device for controlling an excavator according to a second aspect of the present disclosure comprises a receiving part which obtains height information indicating a height according to a plane coordinate of a target object; and a processor which obtains, based on the height information, bend information of the target object according to a plurality of orientation angles which are angles between a reference direction and orientation directions of a bucket, determines, based on the bend information, volumes which can be dug corresponding to the plurality of orientation angles, determines, based on the volumes which can be dug, one or more orientation angles among the plurality of orientation angles, and requests to dig according to the one or more orientation angles.

Also, the one or more orientation angles may include an orientation angle corresponding to a largest volume which can be dug among the plurality of orientation angles.

Also, the processor may determine scan areas corresponding to the plurality of orientation angles, and determine as the volumes which can be dug volumes of the target object overlapped in the scan areas.

Also, the bend information may include information of inclination angles of the target object overlapped in the scan areas, and the inclination angles corresponding to the one or more orientation angles may fall within a predetermined range.

Also, the one or more orientation angles may include an orientation angle corresponding to a greatest inclination angle among the plurality of orientation angles.

Also, the processor may determine, using the bend information, orientation angles within a range where inclination angles of the target object fall within a predetermined range among the plurality of orientation angles, and determine the one or more orientation angles among the orientation angles within the range based on the volumes which can be dug and the inclination angles.

Also, the processor may determine scan areas corresponding to the one or more orientation angles, determine a low point in the scan areas based on bend information corresponding to the scan areas, and perform digging such that the digging starts at the low point.

A third aspect of the present disclosure provides a computer-readable recording medium on which a program for executing the method according to the first aspect is recorded. Or, a fourth aspect of the present disclosure provides a computer program stored in a recording medium for implementing the method according to the first aspect.

According to an embodiment of the present disclosure, digging can be effectively performed at an optimum site in consideration of volumes which can be dug corresponding to a plurality of orientation angles.

Also, a large amount of a target object can be effectively contained in a bucket by determining at which site digging is performed using the information of the target object.

The effects of the present disclosure are not limited to the above-mentioned effects, and it should be understood that the effects of the present disclosure include all effects that could be inferred from the configuration of the disclosed subject matter described in the detailed description or the appended claims.

BRIEF DESCRIPTION OF DRAWINGS

FIG. 1 is a schematic block diagram illustrating the constitution of the device according to an embodiment;

FIGS. 2 to 4 are drawings illustrating the operation of the device according to an embodiment for obtaining bend information of a target object according to a first orientation angle, a second orientation angle and a third orientation angle, respectively;

FIGS. 5 and 6 are drawings illustrating the operation of the device according to an embodiment for obtaining values indicating the average bend of a target object in a scan area by dividing the scan area into a plurality of pile areas;

FIGS. 7 and 8 are drawings illustrating the operation of the device according to an embodiment for obtaining values indicating the average bend of a target object in scan areas by dividing each of a plurality of scan areas according to a plurality of orientation angles into a plurality of pile areas;

FIG. 9 is a drawing illustrating the operation of the device according to an embodiment for determining one or more orientation angles among a plurality of orientation angles based on whether inclination angle falls within a predetermined range; and FIG. 10 is a flow chart showing a method by which the device according to an embodiment controls an excavator.

DETAILED DESCRIPTION

Hereinafter, the present disclosure will be explained with reference to the accompanying drawings. The present disclosure, however, may be modified in various different ways, and should not be construed as limited to the embodiments set forth herein. Also, in order to clearly explain the present disclosure, portions that are not related to the explanation are omitted, and like reference numerals are used to refer to like elements throughout the specification.

The terms as used herein are described as general terms currently used in consideration of the functions mentioned in the present disclosure, but this may vary according to the intention or precedent of a person having ordinary skill in the art, the emergence of new technologies, and the like. In addition, in certain cases, there are terms arbitrarily selected by the applicant, in which case the meaning thereof will be described in detail in the description of the disclosed subject matter. Therefore, the terms as used herein should not be interpreted simply by the names of the terms, but should be interpreted based on the meanings of the terms and the contents throughout the specification.

Throughout the specification, when a component "includes" an element, it means that the component may further include other elements without excluding other elements unless otherwise stated. Also, the terms "unit", "module", and the like described herein refer to a unit for processing at least one function or operation, which may be implemented in hardware or software, or in a combination of hardware and software.

Throughout the specification, when a portion is referred to as being "connected" to another portion, it can be "directly connected to" the other portion, or "indirectly connected to" the other portion having intervening portions present. Also, when a component "includes" an element, it means that the component may further include other elements without excluding other elements unless otherwise stated.

The present disclosure will be explained in detail with embodiments with reference to the accompanying drawings so that a person having ordinary skill in the art to which the present disclosure pertains can easily carry out the present disclosure. The present disclosure, however, may be modified in various different ways, and should not be construed as limited to the embodiments set forth herein.

Hereinafter, embodiments of the present disclosure will be explained in detail with reference to the accompanying drawings.

FIG. 1 is a schematic block diagram illustrating the constitution of the device 100 according to an embodiment.

Referring to FIG. 1, the device 100 can control an excavator 200. In one embodiment, the device 100 may be implemented in a computing device operated by a computer program to execute the functions described herein, and for example, the device 100 may be mounted on the excavator 200 to control the overall operation of the excavator 200 or electrically connected to a controller for controlling the excavator 200 to transmit a control signal to the controller. In another embodiment, the device 100 may include the excavator 200.

The excavator 200 refers to a device capable of excavating a target object, and may include various types of excavators capable of performing excavation in various ways, for example, carrying soil, demolishing constructions, arranging ground, and the like. The excavator 200 may include a bucket 210. In one embodiment, the excavator 200 may include the bucket 210, an arm connected to the bucket 210, a boom connected to the arm, and a controller for controlling these components. For example, the bucket 210 is connected to an end of the arm, and the arm is connected to the boom connected to the upper body of the excavator 200 at the other end thereof, each of which can be rotated around at least one axis by respective cylinders thereof. The bucket 210 can contain a target object (for example, soil) on the ground while being rotated. As used herein, the target object, which is an object to be excavated by the excavator 200, may include all types of target materials which can be carried or loaded by the excavator 200, for example, soil when carrying soil, construction debris when demolishing constructions, ground debris when arranging the ground, etc.

The device 100 may include a receiving part 110 and a processor 120. Hereinafter, various embodiments relating to the operation of each component will be described in more detail with reference to FIGS. 2 to 9.

FIG. 2 is a drawing illustrating the operation of the device 100 according to an embodiment for obtaining height information of a target object.

Referring to FIG. 2, the receiving part 110 may obtain height information indicating a height according to a plane coordinate of the target object. In one embodiment, for the target object (for example, soil) in a predetermined target area 10, the receiving part 110 may generate according to a control signal of the processor 120 spatial information including spatial coordinates (x, y, z) by sensing height information of z axis according to plane coordinates of x axis and y axis.

The height of the target object may be a relative height of the target object to the lowest point (for example, contact ground) of the excavator 200 in one embodiment, and may be an absolute height measured based on a predetermined height in another embodiment, but is not limited to any one of them and various height standards may be applied thereto.

In one embodiment, the height information of the target object may include values indicating an average height per unit area of the target object. For example, the processor 120 may determine a plurality of unit areas having a predetermined unit size (for example, a×b) on the plane coordinates (x, y) in the spatial coordinates (x, y, z) included in the sensed spatial information, and map the height coordinate of z axis thereto by processing average height values obtained by averaging sensed height values for the respective unit areas, thereby providing discrete height information based on the unit size.

In one embodiment, the target area 10 may be an area of a predetermined size which is adjacent to the excavator 200 and can be sensed by the receiving part 110. In another embodiment, the target area 10 may include a scan area 20 that will be described below.

In one embodiment, the receiving part 110 may generate the height information of the target object by sensing the target object. The receiving part 110 may include at least one distance sensing module such as camera, radar, LIDAR, scanner, etc., to generally sense the height information of the terrain in the target area 10 adjacent to the excavator 200 within a predetermined distance, or to sense in real time the height information of the ground in the scan area 20 which can be dug by the excavator 200, which varies according to the rotation of the excavator 200, and to additionally sense and obtain information of the target object including the position, size, shape, type, etc. of the target object and information of the terrain including the type and shape of the surrounding terrain, the angle between the target object and the surrounding terrain, etc.

In another embodiment, the receiving unit 110 may receive the height information of the target object from other devices (for example, server) or other components (for example, memory, sensor, etc.), and may include a wired/wireless communication device connected to other devices through a network, for example, to transmit and receive various information described herein.

The processor 120 may obtain bend information of the target object according to an orientation angle 50 based on the height information of the target object. For example, the processor 120 may obtain information on the bend shape of the ground using the height information of the target object corresponding to the scan area 20 which can be dug by the excavator 200 when the excavator 200 really or virtually rotates according to the predetermined orientation angle 50, while being fixed and can only rotate.

The orientation angle 50 refers to an angle between a reference direction 30 and an orientation direction 40 of the bucket 210. The reference direction 30 may be a frontward direction in which the movement direction of the excavator 200 and the orientation direction 40 of the bucket 210 correspond to each other or may be a specific direction set by a user. The orientation direction 40 of the bucket 210 refers to a longitudinal direction in which the bucket 210 extends from the excavator 200.

The processor 120 may obtain, based on the height information of the target object, bend information of the target object according to a plurality of orientation angles 50. FIGS. 2 to 4 illustrate the operation of the device 100 according to an embodiment for obtaining bend information of a target object according to a first orientation angle 51, a second orientation angle 52 and a third orientation angle 53, respectively.

Referring to FIG. 2, the processor 120 may determine, based on the height information of the target object, first bend information indicating the bend of a scan area 20 which can be dug, when the angle between the reference direction 30 and the orientation direction 40 of the bucket 210 is the first orientation angle 51 (for example, 0). For example, the processor 120 may determine a first scan area 21 to cover the width of the bucket 210 around the orientation direction 40 of the bucket 210 which rotates (or expected from virtual rotation) according to the first orientation angle 51 (for example, 0), while the excavator 200 is fixed, and calculate the variation of height of the target object according to the orientation direction 40 of the bucket 210 in the first scan area 21, to derive the first bend information indicating the degree to which the target object is bent along the orientation direction 40 of the bucket 210. It is determined that the greater the bend degree is and the higher height the target object has, the more amount the target object can be dug in the scan area 20.

Referring to FIG. 3, the processor 120 may determine, based on the height information of the target object, second bend information indicating the bend of the scan area 20 which can be dug, when the angle between the reference direction 30 and the orientation direction 40 of the bucket 210 is the second orientation angle 52 (for example, θ). Similarly, the processor 120 may determine a second scan area 22 to cover the width of the bucket 210 around the orientation direction 40 of the bucket 210 which virtually rotates according to the second orientation angle 52 (for example, θ), while the excavator 200 is fixed, and calculate the variation of height of the target object according to the orientation direction 40 of the bucket 210 in the second scan area 22, to derive the second bend information indicating the degree to which the target object is bent along the orientation direction 40 of the bucket 210.

Referring to FIG. 4, the processor 120 may determine, based on the height information of the target object, third bend information indicating the bend of the scan area 20 which can be dug, when the angle between the reference direction 30 and the orientation direction 40 of the bucket 210 is the third orientation angle 53 (for example, 2θ). Similarly, the processor 120 may determine a third scan area 23 to cover the width of the bucket 210 around the orientation direction 40 of the bucket 210 which virtually rotates according to the third orientation angle 53 (for example, 2θ), while the excavator 200 is fixed, and calculate the variation of height of the target object according to the orientation direction 40 of the bucket 210 in the third scan area 23, to derive the third bend information indicating the degree to which the target object is bent along the orientation direction 40 of the bucket 210.

As such, the processor 120 may determine N orientation angles 50 (N is a natural number) according to a predetermined reference interval (for example, θ), determine, using the height information of the target object, Nth bend information indicating the bend of height of the target object in the Nth scan area 20 according to the respective N orientation angles 50, and identify an amount of the target object to be dug for various orientation angles by adjusting the reference interval (for example, θ) according to the user's settings or in consideration of the surrounding terrain.

FIGS. 5 and 6 are drawings illustrating the operation of the device 100 according to an embodiment for obtaining values indicating the average bend of a target object in a scan area 20 by dividing the scan area 20 into a plurality of pile areas.

Referring to FIG. 5, the processor 120 may divide the scan area 20 determined according to the orientation angle 50 into a plurality of pile areas having a predetermined size (for example, m×n), and determine values indicating the average height per pile area of the target object for each of the plurality of pile areas. For example, the processor 120 may three-dimensionally manage the spatial coordinates (x, y, z) in the spatial information by showing the height Z on the plane coordinates as illustrated in FIG. 5. When the target area 10 is made up of unit areas (having a size of a×b) with respect to the whole size (X×Y), the processor 120 may divide the scan area 20 into pile areas having a unit size (for example, m×n=4a×3b) which is obtained by applying predetermined multiples to the unit area, and calculate the average height value of the target object for each pile area.

In one embodiment, the processor 120 may determine the average height per pile area in the scan area 20 based on Equation 1 below. For example, in the case of dividing the first scan area 21 according to the first orientation angle 51 (for example, j=1) among the j orientation angles 50 into k pile areas by applying the unit size of m (=4)×n (=3) to the unit area (=1×1), the processor 120 may calculate the average height value $N_{jk}$ for each pile area by dividing the sum of the height values $Z_i$ of the respective unit areas $Z_1$, $Z_2$, 쩐, $Z_{12}$ for each pile area by m×n according to Equation 1.

$$N_{jk} = \frac{\sum_{i=1}^{m*n} Z_i}{m*n} \quad \text{[Equation 1]}$$

Referring to FIG. 6, the processor 120 may determine bend information including the information of an inclination angle of the target object overlapped in the scan area 20. In one embodiment, the processor 120 may determine the inclination angle of the target object in the scan area 20 based on the average of variation of the values indicating the average height for each pile area of the target object. For example, as illustrated in FIG. 6, the processor 120 may determine the bend line by connecting the average height values of the pile areas along the orientation direction 40 of the bucket 210 (or in the y-axis direction), and determine an inclination angle of the target object by calculating the average slope of the bend line with respect to the orientation direction 40 of the bucket 210 (or y-axis direction), thereby quantifying the degree of bend in the scan area 20 as to the height of the target object.

In one embodiment, the inclination angle of the target object may refer to an angle between the ground and the average slope of the bend line, and may be determined based on an angle between a reference line (for example, y axis) and a line connecting a plurality of points of which the rate of change of average height is a predetermined value or less (for example, 0) in the bend line.

FIGS. 7 and 8 are drawings illustrating the operation of the device 100 according to an embodiment for obtaining values indicating the average bend of a target object in scan areas 20 by dividing each of the plurality of scan areas 20 according to a plurality of orientation angles 50 into a plurality of pile areas.

Referring to FIGS. 7 and 8, similarly, the processor 120 may divide each of the first scan area 21 according to the first orientation angle 51, the second scan area 22 according to the second orientation angle 52, and the third scan area 23 according to the third orientation angle 53 into pile areas having a predetermined size (for example, m×n), and determine values indicating the average height per pile area of the target object for each of the pile areas. The processor 120 may determine the height inclination angles of the target object for the first scan area 21 to the third scan area 23, respectively, based on the average of variation of the values indicating the average height per pile area of the target object.

In one embodiment, the processor 120 may determine the average height per pile area for each of the plurality of scan areas 20 based on at least one of Equations 2 and 3 below. For example, the processor 120 may divide the jth scan area 20 according to the jth orientation angle 50 into k pile areas and group $Y_1$, $Y_2$, . . . , $Y_k$ as PY to calculate the average height value $N_{jk}$ for each pile area in PY, group the average height values $N_{jk}$ of the pile areas in PY for each of the j scan areas 20 to determine j $PA_j$ groups, and connect the grouped $N_{jk}$ values for each of the $PA_j$ groups to determine j bend lines.

$$N_{jk} = \frac{\sum_{i=1}^{m*n} Z_i}{m*n} \quad \text{[Equation 2]}$$

$$PA_1 = [N_{1k}, \cdots, N_{12}, N_{11}]$$

$$PA_2 = [N_{1k}, \cdots, N_{12}, N_{11}]$$

$$\vdots$$

$$PA_j = [N_{1k}, \cdots, N_{12}, N_{11}]$$

$$PY = [Y_k, \cdots, Y_2, Y_1]$$

$$k = Y/n \quad \text{[Equation 3]}$$

(wherein Y refers to the total number of unit areas in the scan area 20 with respect to the y-axis direction)

In one embodiment, the processor 120 may additionally use Equation 4 below to determine inclination angles of the target object. For example, as illustrated in FIG. 8, the processor 120 may use the polyfit function which obtains a line graph from the relationship between discretely distributed points, to determine $\text{Poly_PA}_j$ indicating the bend line for each of the j scan areas 20 and determine as the inclination angle an angle between a reference surface (for example, ground) and $\text{Poly_PA}_j$.

$$\text{Poly_PA}_1 = polyfit(PA_1, PY, 1) \quad \text{[Equation 4]}$$

$$\vdots$$

$$\text{Poly_PA}_j = polyfit(PA_j, PY, 1)$$

(wherein polyfit( ) is a function which can determine the shape of a line graph from the values ($N_{jk}$) in the $PA_j$ group by using (x-axis data, y-axis data, degree) given in brackets)

In one embodiment, the processor 120 may additionally use Equation 5 below to determine a pile area Lube indicating whether the inclination angle of the target object is calculated through a sufficient number of pile areas. For example, the processor 120 may determine Lube-$PA_j$ indicating a pile area Lube value for each of the j scan areas 20 according to Equation 5 below, and quantify information on whether each scan area 20 is divided into a sufficient number of pile areas and many height values are reflected when calculating the inclination angle for each of the scan areas 20.

$$\begin{aligned} \text{Lube_PA}_1 &= \text{sum}[\{(PA_1 + \text{abs}(Z_{min})\} \cdot * \\ &\quad \{(m * \text{x_resolution}) * (n * \text{y_resolution})\}] \\ &\quad . \\ &\quad . \\ \text{Lube_PAj} &= \text{sum}[\{(PA_1 + \text{abs}(Z_{min})\} \cdot * \\ &\quad \{(m * \text{x_resolution}) * (n * \text{y_resolution})\}] \end{aligned} \quad \text{[Equation 5]}$$

(wherein m and n are sizes in the x-axis direction and y-axis direction, respectively, which a plurality of pile areas divided from the scan area 20 have, as described above, x_resolution and y_resolution are resolution of x axis (for example, size of unit area in the x-axis direction, a) and resolution of y axis (for example, size of unit area in the y-axis direction, b), respectively, and abs( ) is a function calculating an absolute value of the value given in brackets)

In one embodiment, the result of analysis is obtained, using Poly-$PA_j$ and Lube-$PA_j$ calculated according to Equations 4 and 5, as to the volume which can be dug for each of the j scan areas 20, the degree to which the orientation angle is great, whether a sufficient number of Lubes are calculated for each scan area 20, etc. The result of analysis may be reflected in determination of one or more orientation angles 50 for digging in the subsequent step.

The processor 120 may determine volumes which can be dug corresponding to a plurality of orientation angles 50 based on the bend information. For example, the processor 120 may calculate as the area the degree to which the height of the target object is bent with respect to the plane surface to calculate an amount of the target object which can be dug.

In one embodiment, the processor 120 may determine the scan areas 20 corresponding to the plurality of orientation angles 50, and determine as the volumes which can be dug volumes of the target object overlapped in the scan areas 20. For example, for each of the first scan area 21 to the third scan area 23 according to the first orientation angle 51 to the third orientation angle 53, respectively, the processor 120 may determine as the volume which can be dug a value obtained by integrating the bend line which connects the average heights of the pile areas with respect to at least one of the y-axis direction and the z-axis direction.

The processor 120 may determine one or more orientation angles 50 among the plurality of orientation angles 50 based on the volume which can be dug, and request to dig according to the determined one or more orientation angles. For example, in one embodiment, the processor 120 may determine, based on a plurality of bend information, one or more orientation angles 50 in which the amounts of the target object which can be dug are equal to or greater than the amount of a predetermined level among the plurality of orientation angles 50, and move the excavator 200 and control the overall excavation work so that the digging is performed at the determined one or more orientation angles 50.

As described herein, "one or more orientation angles" are terms distinguished from "a plurality of orientation angles," and the terms are used to represent that one orientation angle 50 or two or more orientation angles 50 may be determined for digging according to the volumes which can be dug determined through the aforementioned step.

In one embodiment, the one or more orientation angles 50 may include an orientation angle 50 corresponding to the largest volume which can be dug among the plurality of orientation angles 50. For example, the orientation angle with the largest volume which can be dug among the plurality of orientation angles 50 may be determined as the one or more orientation angles, so as to effectively perform digging at the site analyzed to have the largest amount of the target object which can be dug.

In one embodiment, the one or more orientation angles 50 may include an orientation angle 50 corresponding to the greatest inclination angle among the plurality of orientation angles 50. For example, the orientation angle with the greatest slope of the bend line according to the average heights of the pile areas among the plurality of orientation angles 50 may be determined as the one or more orientation angles, so as to efficiently determine whether the amounts of the target object which can be dug are large or small.

FIG. 9 is a drawing illustrating the operation of the device 100 according to an embodiment for determining one or more orientation angles 50 among a plurality of orientation angles 50 based on whether inclination angle falls within a predetermined range.

Referring to FIG. 9, the processor 120 may determine one or more orientation angles 50 among the plurality of orientation angles 50 based on the information of inclination angles of the target object included in the bend information, and the determined one or more orientation angles 50 may fall within a predetermined range. For example, in case where a first inclination angle corresponding to a first orientation angle 51 with the largest volume which can be dug and the greatest inclination angle among the plurality of orientation angles 50 is determined as a reference numeral 910, and falls within a predetermined range of a reference numeral 920, the first orientation angle 51 may be determined as one or more orientation angles 50 for digging. For another example, in case where a second inclination angle corresponding to a second orientation angle 52 with the largest volume which can be dug and the greatest inclination angle among the plurality of orientation angles 50 deviates from the predetermined range of the reference numeral 920, the second orientation angle 52 may be excluded from one or more orientation angles 50 for digging.

In one embodiment, the processor 120 may determine, using the bend information, orientation angles within a range where the inclination angles of the target object fall within the predetermined range 920 among the plurality of orientation angles 50, and determine one or more orientation angles among the orientation angles within the range based on the volumes which can be dug and the inclination angles. For example, one or more orientation angles may be determined which are basically included in the orientation angles within the predetermined range 920 and additionally satisfy the predetermined conditions for the volume which can be dug and the inclination angle. In the case of too gradual average slope, the bucket is to go farther from the center of the excavator 200, and also the arm is to be longer to fill the bucket with a certain amount of soil, etc., which might reduce excavation efficiency.

In one embodiment, the one or more orientation angles 50 may include an orientation angle 50 which has the greatest number of heights reflected in the pile areas, while falling within the predetermined range 920, among the plurality of orientation angles 50, and for example, a scan area 20 may be selected in which the greatest number of height values are averaged for the plurality of pile areas obtained by dividing the scan area 20, while having the greatest inclination angle, among those within an appropriate angle range.

In one embodiment, the predetermined range 920 may be adjusted from a predetermined value according to the type of target object and the type of digging. For example, the predetermined range 920 may be adjusted upward or downward by a certain rate from the predetermined value based on whether the particle size is large or small according to the type of target object, a strong pressure is required according to the type of digging, etc.

In one embodiment, one or more orientation angles 50 may be determined based on different priorities given to the volume which can be dug and the inclination angle. For example, orientation angles 50 may be determined based on higher priorities given in the order of the volume which can be dug and the inclination angle. In another embodiment, higher priorities may be given in the order of the volume which can be dug, the inclination angle, and the number of heights reflected in the pile areas.

The processor 120 may request to dig according to the determined one or more orientation angles 50. For example, when one orientation angle 50 is determined, the processor 120 may control the excavator 200 to rotate to the orientation angle 50, while being fixed, so as to perform digging at the orientation angle 50, and start digging at that point, but is not limited thereto and may control site change, rotational movement, and overall digging work depending on situations.

In one embodiment, the processor 120 may determine the scan areas 20 corresponding to the determined one or more orientation angles 50, determine a low point in the scan areas 20 based on the bend information corresponding to the determined scan areas 20, and perform digging such that the digging starts at the low point. For example, referring to a reference numeral 610 in FIG. 6, in case where the first orientation angle 51 is determined, the processor 120 may detect $Y_2$, which is the low point having the lowest height in the bend line corresponding to the first scan area 21, and control the tip of the bucket 210 to contact the site corresponding to $Y_2$ first, such that the digging starts at that site.

In one embodiment, the low point may include a point having the lowest height of the target object in the scan areas 20, and may be a point having the lowest height in each scan area 20, as illustrated in FIG. 6.

In one embodiment, the low point may be less than the average height of the target object in the scan area 20 by a predetermined value or more, and the rate of change of height of the target object in the scan area 20 may correspond to 0. For example, a point, which is not even the lowest point, may be determined as a low point when the point is sufficiently smaller than $H_L$ which is calculated as the average height of the target object in the scan area 20 and the slope of the bend line at the point is 0 or falls within a predetermined range (for example, ±0.1) including 0.

In one embodiment, the low point may be positioned far away from the excavator 200 by a predetermined distance or more. For example, in case where there are a first point which has a lowest height of the target object in the scan area 20 but is close to the excavator 200 within the predetermined distance, and a second point which has a height greater than that of the first point but is positioned far away from the excavator 200 by the predetermined distance or more, the second point may be determined as the low point.

In one embodiment, the predetermined distance may be set in various ways. In one embodiment, the predetermined distance may be determined according to the total volume of target object. For example, the smaller the volume which can be dug in the scan area 20 is, the farther the distance may be set, and the larger the volume which can be dug is, the shorter the distance may be set. In case where there is a sufficiently large amount to be dug, a short reference distance may be set to determine as the digging point a point which is the low point even though it is close, and in case where there is a small amount to be dug, a long reference distance is set to determine as the digging point a point which is sufficiently distanced away even though it is the low point, in consideration of digging efficiency, safety, etc.

In one embodiment, the predetermined distance may be determined according to the type of target object and the type of digging. For example, in the case of the target object having small particle sizes, a short distance may be set, and in the case of the target object having large particle sizes, a long distance may be set. For another example, in the case of requiring a strong pressure for digging (for example, digging along with crushing), a short distance may be set, and in the case of not requiring a strong pressure for digging (for example, light digging), a long distance may be set.

In one embodiment, in case where there are two or more orientation angles as the determined one or more orientation angles 50, the processor 120 may perform digging sequentially for the two or more orientation angles 50 according to predetermined priorities. For example, in case where the first orientation angle 51 and the second orientation angle 52 which have volumes which can be dug of a predetermined value or more are determined, the processor 120 may control to perform digging first according to one of the first orientation angle 51 and the second orientation angle 52 which has the larger volume which can be dug, and perform digging subsequently according to the other one.

In one embodiment, the priorities may be determined based on at least one of the angle of the orientation angle 50, the distance from the excavator 200, the volume which can be dug, the inclination angle of the target object, the low point and the inclination angle of the surrounding terrain. For example, high priorities may be given when the variation of rotation angle is smaller as the angle of the orientation angle 50 is small with respect to the current state of the excavator 200, the low point determined as the point where the digging starts is closer to the excavator 200, the amount to be dug is larger, the inclination angle of the target object is greater in the predetermined range, the low point is lower, and the average slope between the excavator 200 and the surrounding terrain is smaller. In one embodiment, high priorities may be given in the order of the angle of the orientation angle 50, the distance from the excavator 200, the volume which can be dug, the inclination angle of the target object, the low point, and the inclination angle of the surrounding terrain.

In one embodiment, the processor 120 may perform a series of operations to control the excavator 200. For example, the processor 120 may be implemented in a central processor unit (CPU) for controlling the overall operation of the device 100. For another example, the processor 120 may be implemented in a controller for controlling the excavator 200, and may be electrically connected with the receiving part 110 and other components to control data flow therebetween.

Also, a person having ordinary skill in the art would understand that the device 100 may further include general components other than the components illustrated in FIG. 1. For example, the device 100 may further include a memory for storing data used for the overall operation, input/output interfaces for receiving user's input or outputting information, etc.

FIG. 10 is a flow chart showing a method by which a device 100 according to an embodiment controls an excavator 200.

Referring to FIG. 10, in step S1010, the device 100 may obtain height information indicating a height according to the plane coordinate of the target object. In one embodiment, the height information may include values indicating average height per unit area of the target object.

In step S1020, the device 100 may determine, based on the height information, bend information of the target object according to a plurality of orientation angles 50 which are angles between a reference direction 30 and orientation directions 40 of a bucket. In one embodiment, the bend information may include information of inclination angles of the target object overlapped in scan areas 20 corresponding to the plurality of orientation angles 50.

In step S1030, the device 100 may determine, based on the bend information, volumes which can be dug corresponding to the plurality of orientation angles 50. In one embodiment, the device 100 may determine as the volumes which can be dug volumes of the target object overlapped in the scan areas 20.

In step S1040, the device 100 may determine, based on the volumes which can be dug, one or more orientation angles 50 among the plurality of orientation angles 50. In one embodiment, the device 100 may determine, using the bend information, orientation angles in a range where inclination angles of the target object fall within a predetermined range among the plurality of orientation angles 50, and determine one or more orientation angles 50 among the orientation angles based on the volumes which can be dug and the inclination angles.

In step S1050, the device 100 may perform digging according to the determined one or more orientation angles. In one embodiment, the device 100 may determine the scan areas 20 corresponding to the determined one or more orientation angles, determine a low point in the scan areas 20 based on the bend information corresponding to the scan areas 20, and perform digging such that the digging starts at the low point.

According to an embodiment of the present disclosure, an optimum site is determined for performing digging, using the volumes which can be dug and the inclination angles of the target object, etc. corresponding to the plurality of orientation angles, thereby allowing the bucket 210 to effectively contain a large amount of target object.

The order and combination of the aforementioned steps is merely an embodiment, and it can be understood that the present disclosure can be carried out variously in a way that the order, combination, function, and performing subject thereof are added, omitted or changed, without deviating from the essential characteristics of each element described herein.

Meanwhile, the method may be written in a computer executable program, and implemented in a general digital computer which activates the program using a computer-readable recording medium. Also, the structure of data used in the aforementioned method may be recorded in a computer-readable recording medium using various means. The computer-readable recording medium includes a magnetic storage medium (for example, ROM, RAM, USB, floppy disk, hard disk, etc.), an optical readable medium (for example, CD-ROM, DVD, etc.), and the like.

The foregoing description of the present disclosure has been presented for illustrative purposes, and it is apparent to a person having ordinary skill in the art that the present disclosure can be easily modified into other specific forms without changing the technical idea or essential features of the present disclosure. Therefore, it should be understood that the forgoing embodiments are by way of example only, and are not intended to limit the present disclosure. For example, each component which has been described as a unitary part can be implemented as distributed parts. Likewise, each component which has been described as distributed parts can also be implemented as a combined part.

The scope of the present disclosure is presented by the accompanying claims, and it should be interpreted that all changes or modifications derived from the definitions and scopes of the claims and their equivalents fall within the scope of the present disclosure.

The invention claimed is:

1. A method for controlling an excavator, comprising:

obtaining height information indicating a height according to a plane coordinate of a target object;

defining a plurality of distinct orientation angles;

wherein each orientation angle is an angle between a reference direction and an orientation direction of a bucket;

obtaining, based on the height information, bend information of the target object for each of the defined plurality of distinct orientation angles, wherein obtaining the bend information includes dividing a scan area corresponding to the orientation angle into a plurality of pile areas and determining values indicating an average height per pile area of the target object for each of the plurality of pile areas;

determining, based on the bend information, a respective volume which can be dug corresponding to each of the defined plurality of distinct orientation angles;

determining, based on the respective determined volumes, one or more orientation angles from among the defined plurality of orientation angles; and digging according to the one or more determined orientation angles.

2. The method of claim 1, wherein the one or more determined orientation angles include an orientation angle corresponding to a largest volume which can be dug among the defined plurality of distinct orientation angles.

3. The method of claim 1, wherein the step of determining a respective volume which can be dug corresponding to each of the defined plurality of distinct orientation angles comprises:

determining scan areas corresponding to each of the defined plurality of distinct orientation angles; and determining as the respective volumes which can be dug volumes of the target object overlapped in the determined scan areas.

4. The method of claim 3, wherein the bend information includes information of inclination angles of the target object overlapped in the determined scan areas, and the inclination angles corresponding to the one or more determined orientation angles fall within a predetermined range.

5. The method of claim 4, wherein the one or more determined orientation angles include an orientation angle corresponding to a greatest inclination angle among the defined plurality of distinct orientation angles.

6. The method of claim 3, wherein the step of determining, based on the respective determined volumes, one or more orientation angles from among the defined plurality of distinct orientation angles comprises:

determining, using the bend information, orientation angles within a range where inclination angles of the target object fall within a predetermined range among the defined plurality of distinct orientation angles; and determining the one or more orientation angles from among the orientation angles within the range based on the respective determined volumes that can be dug and the inclination angles.

7. The method of claim 1, wherein the digging according to the one or more determined orientation angles comprises:

determining scan areas corresponding to the one or more determined orientation angles;

determining a low point in the determined scan areas based on bend information corresponding to the determined scan areas; and performing digging such that the digging starts at the low point.

8. The method of claim 7, wherein the low point includes a point where the target object has a lowest height in the determined scan areas.

9. The method of claim 7, wherein the low point is less than an average height of the target object in the determined scan areas by a predetermined value or more, and a rate of change of height of the target object in the determined scan areas corresponds to 0.

10. The method of claim 1, wherein the height information includes values indicating an average height per unit area of the target object.

11. A computer-readable recording medium storing a program for executing the method of claim 1.

12. A device for controlling an excavator, comprising:

a receiving part which obtains height information indicating a height according to a plane coordinate of a target object; and a processor which defines a plurality of distinct orientation angles, wherein each orientation angle is an angle between a reference direction and an orientation direction of a bucket, obtains, based on the height information, bend information of the target object for each of the defined plurality of distinct orientation angles, determines, based on the bend information, a respective volume which can be dug corresponding to each of the defined plurality of distinct orientation angles, determines, based on the respective determined volumes, one or more orientation angles from among the defined plurality of orientation angles, and requests to dig according to the one or more determined orientation angles, wherein the bend information is obtained by dividing a scan area corresponding to the orientation angle into a plurality of pile areas and determining values indicating an average height per pile area of the target object for each of the plurality of pile areas.

13. The device of claim 12, wherein the one or more determined orientation angles include an orientation angle corresponding to a largest volume which can be dug among the defined plurality of distinct orientation angles.

14. The device of claim 12, wherein the processor determines scan areas corresponding to each of the defined plurality of orientation angles, and determines as the respective volumes which can be dug volumes of the target object overlapped in the determined scan areas.

15. The device of claim 14, wherein the bend information includes information of inclination angles of the target object overlapped in the determined scan areas, and the inclination angles corresponding to the one or more determined orientation angles fall within a predetermined range.

* * * * *